United States Patent [19]

Lansford

[11] Patent Number: 4,903,628

[45] Date of Patent: Feb. 27, 1990

[54] PRESSURE EQUALIZER

[76] Inventor: William Lansford, P.O. Box 4007, Key West, Fla. 33041

[21] Appl. No.: 267,101

[22] Filed: Nov. 7, 1988

[51] Int. Cl.[4] ..... B63G 8/00

[52] U.S. Cl. ..... 114/312; 114/334; 405/193

[58] Field of Search ..... 114/312, 334, 335, 342, 114/330, 331; 405/193; 354/64; 73/170 A

[56] References Cited

U.S. PATENT DOCUMENTS

| | | | |
|---|---|---|---|
| 1,131,712 | 3/1915 | Klein | 354/64 |
| 3,112,724 | 12/1963 | Rosen | 405/193 X |
| 3,759,605 | 9/1973 | Johnson | 354/64 X |
| 4,031,581 | 6/1977 | Baugh | 441/29 |

*Primary Examiner*—Sherman D. Basinger

*Attorney, Agent, or Firm*—Lowe, Price, LeBlanc, Becker & Shur

[57] ABSTRACT

A pressure equalizing cabinet for instruments intended to be submerged in water is described. The device includes a source of compressed air and a piston in a cylinder. One side of the piston is in communication with the interior of the cabinet and the other side is in communication with the ambient. The piston also mounts a needle valve at a port in a conduit between this source of compressed air and the cabinet interior. When the pressure in the ambient exceeds the internal pressure, the piston is displaced to admit a flow of compressed air into the cabinet. When the pressure in the cabinet exceeds the ambient the piston closes the valve. A bleed valve is also provided for venting excess pressure within the cabinet during ascent.

3 Claims, 1 Drawing Sheet

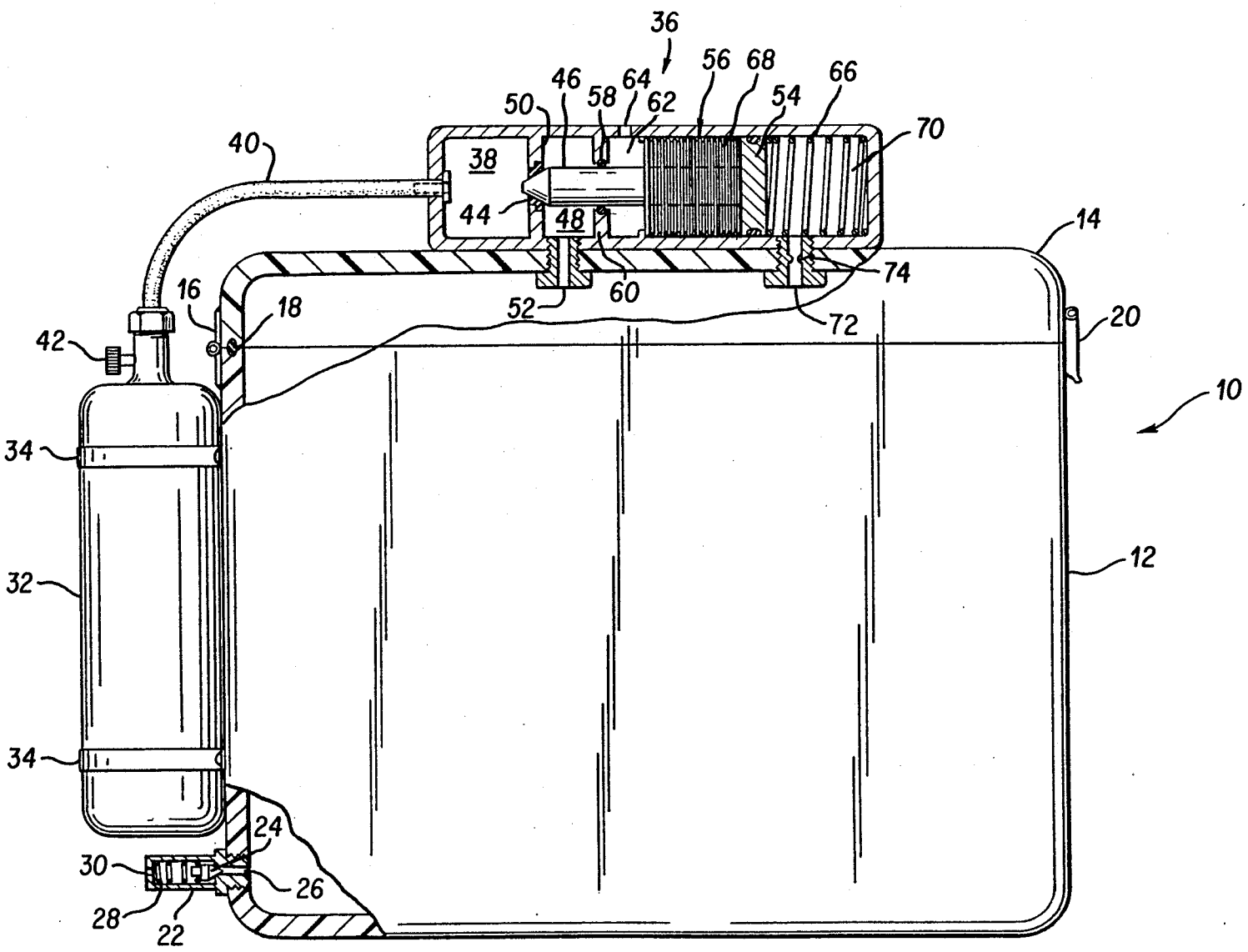
10
12
14
20
70
74
72
66
54
68
56
36
62
64
58
60
46
48
50
52
38
44
40
18
16
42
34
32
34
24
26
22
30
28

PRESSURE EQUALIZER

FIELD OF THE INVENTION

This invention relates to a means for equalizing pressure in an undersea instrument cabinet and specifically to a lightweight instrument cabinet which will during descent maintain an internal pressure slightly above the ambient water pressure and during ascent will gradually bleed the pressure off.

DESCRIPTION OF THE PRIOR ART

If it is desired to locate a package of instruments on the ocean floor, normally the instrument cabinet will be constructed of heavy metal to withstand water pressure at the ocean floor. Such a cabinet then would be quite heavy and would therefore be difficult to retrieve. In addition, if the cabinet is to be modified, it would be difficult due to the fact that the wall construction would have to be cut and modification pieces welded. Furthermore, the access port would be difficult to seal unless it is welded. Any seal, over the passage of time, at extreme water pressure, could leak and ruin the instruments disposed in the cabinet.

It is known to use compressed air or other gas in a floatation apparatus to either displace or admit water and thereby establish a neutral buoyancy at a desired depth. For example, in U.S. Pat. Nos. 3,257,672, 3,860,983 and 4,031,581 are disclosed various apparatus for establishing neutral buoyancy in a floatation device. The ballast however in each instance is water and there is no teaching for pressurizing a cabinet without the presence of water therein.

In U.S. Pat. No. 3,293,676 an instrument package cabinet is described. In that patent however, a hydrogen generator is used to generate hydrogen gas and achieve a positive buoyancy to raise a submerged cabinet. There is no description therein however for using a source of compressed gas to regulate internal pressure during descent without using water as a ballast.

SUMMARY OF THE INVENTION

It has been discovered however that a lightweight instrument cabinet can be provided which could even be constructed of plastic and which will ensure that instruments disposed therein will remain dry when disposed on the ocean floor. The device of this invention pressurizes the interior of the cabinet responsive to ambient water pressure and ensures that the internal cabinet pressure will always be slightly higher than the ambient water pressure. The cabinet utilizes a source of compressed air or other gas and a cylindrical piston. One side of the piston is in communication with the ambient atmosphere and the opposite side of the piston is in communication with the interior of the cabinet. That side of the piston is also biased to a normally closed position. When the ambient pressure exceeds the total of the force of the spring and the internal pressure within the cabinet, the piston retracts and admits compressed air to the interior of the cabinet until the pressure is equalized. Then the needle valve is closed by the spring. A one way bleed valve is also provided on the cabinet so that when the package ascends, the pressure there within will gradually equalize.

Accordingly, it is an object of this invention to provide a pressure equalizing system for undersea instrument cabinets.

It is another object of this invention to provide a pressure equalizer which will automatically pressurize the interior of a cabinet as the cabinet descends to a pressure slightly exceeding ambient, and which will bleed off the internal pressure as the cabinet ascends.

It is yet another object of this invention to provide an instrument cabinet which may be constructed of lightweight material and which will withstand water pressure at the ocean floor and which will gradually pressurize as the cabinet descends by the controlled admission of compressed air or other gas into the cabinet responsive to the change in ambient water pressure and which will further contain a one way bleed valve so that when the cabinet ascends the internal pressure will gradually bleed off.

These and other objects will become readily apparent with reference to the drawing and following descriptions wherein:

BRIEF DESCRIPTION OF DRAWINGS

The FIGURE is a plan view in partial section of a cabinet containing the pressure equalizer of this invention.

DETAILED DESCRIPTION OF THE INVENTION

With attention to the drawing, the cabinet of this invention 10 typically consists of a case 12 with a lid 14 which is affixed to case 12 by hinges 16. An internal O-ring seal 18 would further be provided and a latch 20. It will be obvious to those skilled in the art that the cabinet 10 depicted herein is exemplary and shown for the purposes of illustration. The pressure equalizer of this invention as will be subsequently explained could be adapted to any type of cabinet. Furthermore, while the cabinet of this invention could be constructed of a lightweight material such as plastic, this invention is not intended to be limited to the materials of construction.

Cabinet 10 is equipped with a one way bleed valve 22 which is normally closed. Bleed valve 22 includes a needle 24 which is normally urged into orifice 26 by spring 28. When the pressure within the cabinet 10 exceeds the ambient pressure plus that of the spring, the needle 24 will retract and release the pressure through orifice 26 and port 30. Therefore, bleed valve 22 functions to equalize internal pressure with the ambient when the internal pressure exceeds external and will provide an internal pressures lightly above ambient water pressure due to the additive force of spring 28 on needle 24.

The bleed valve serves its function only during ascent. The bleed is not what establishes pressure above abient during descent and while on the bottom. The orifice accomplishes this. The bleed valve mostly prevents over pressure during the ascent.

A source of compressed air or other gas is contained within tank 32 which is affixed by for example brackets 34 to cabinet 10. A cylinder 36 is also affixed to cabinet 10 be any conventional means. Cylinder 36 consists of a chamber 38 which communicates with the source of compressed air 32 via line 40. Valve 42 on tank 32 would normally be open. Chamber 38 has a normally closed port 44 which is closed by needle 46. Chamber 48 disposed behind wall 50 communicates with the interior of cabinet 10 via port 52. Therefore, when needle 46 closes port 44, the pressure within chamber 48 will be the same as that within cabinet 10. Needle 46 however is mounted on one side of a piston which is slidably received within cylinder 56. Needle 46 extends through a port 58 in wall 60. Wall 60 then defines chamber 62 which in communication with the ambient via port 64.

When cabinet 10 is disposed out of the water, spring 66 normally urges needle 46 laterally to close port 44 so that chambers 38 and 48 are not in communication. However, when the cabinet 10 is lowered into the water, water fills chamber 62. Bellows 68 is provided to assist in sealing chamber 62 from chamber 70 which houses spring 66 and is in communication with the interior of cabinet 10 via port 72.

As pressure builds in chamber 62, piston 54 will cause spring 66 to retract and thereby open port 44 whereby compressed air from the source 32 will enter chamber 48 and the interior of cabinet 10 via port 52 then into chamber 70 via port 72. When the pressure within the cabinet 10 plus the force of spring 66 equals the external water pressure, needle 46 will close port 44.

It must be emphasized that a small orifice 74 is provided in port 72 so that the pressure in chamber 70 will lag the interior pressure within cabinet 10. Therefore, the pressure within cabinet 10 as the package descends, will also exceed that of chamber 70 and thus also the ambient water pressure.

Because the ambient water pressure will never be in excess of the pressure within cabinet 10, the cabinet by definition cannot leak and need not be of rigid construction.

When the package ascends, as noted above, one way valve 22 will open and vent the internal pressure within cabinet 10. Because needle 24 is biased, the pressure within cabinet 10 during ascent will also always exceed the ambient water pressure. Therefore, during descent or ascent, the cabinet 10 cannot leak.

By utilizing the pressure equalizer of this invention, the need for a rigid heavy metal construction is eliminated. In addition, elaborate sealing techniques or the welding of the access port is also unnecessary because the device of this invention cannot leak so long as the source of compressed air contains sufficient air to exceed the maximum water pressure.

While compressed air is the gas to which referred, it will be understood by those skilled in the art that tank 32 could contain for example liquid nitrogen or carbon dioxide or a compressed gas other than air within the scope of this invention.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

I claim:

1. A pressure equalizing instrument cabinet for keeping submerged instruments dry comprising:

a housing having an access port and a door normally closing said port in sealing engagement therewith;

reservoir means affixed to said cabinet for containing a source of a gas under pressure;

a cylinder and piston slidably retained therein affixed to the exterior of said cabinet, first port means on a first side of said piston in communication through said cylinder with the ambient, second port means on an opposite second side of said piston in communication through said cylinder and cabinet with the interior of said cabinet;

pressure equalizing means coupled between said reservoir means and cabinet for admitting gas under pressure to the interior of said cabinet only when the pressure in the first side of the piston exceeds pressure on the second side thereof; and bleed valve means mounted on the cabinet for venting gas therewithin to the sea during the ascent when the pressure inside the cabinet exceeds the ambient pressure on the first side; and bias means on the second side of said piston normally urging said piston toward the first side and said second port means further comprises lag means for maintaining the pressure within said cabinet higher than the pressure on the second side of said piston and thus higher than ambient pressure.

2. The cabinet of claim 1 wherein said cylinder defines a first chamber on the first side of said piston in communication with the ambient and a second chamber on the second side thereof; said second port means including a conduit extending from the second chamber into the cabinet; and said lag means includes an orifice in said first conduit.

3. The cabinet of claim 2 wherein said cylinder defines an entrance chamber having an entrance port and an exit port and said pressure equalizing means includes a second conduit connecting said reservoir and entrance chamber through the entrance port; and valve means normally closing said port and coupled to said piston for opening said port when the pressure in the first chamber exceeds that in the second chamber plus therefore of the spring; and third conduit connecting the exit port and the interior of said cabinet for admitting pressurized gas thereto when the entrance port is open.

* * * * *